US007221997B2

(12) United States Patent
Bongers et al.

(10) Patent No.: US 7,221,997 B2
(45) Date of Patent: May 22, 2007

(54) METHOD FOR PROCESS CONTROL AND DOCUMENTATION IN A BOXING MACHINE

(75) Inventors: Hans-Werner Bongers, Laupheim (DE); Fritz Fochler, Senden (DE); Jörg Riekenbrauck, Schwendi (DE); Detlev Gertitschke, Laupheim (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 230 days.

(21) Appl. No.: 11/050,635

(22) Filed: Feb. 1, 2005

(65) Prior Publication Data

US 2005/0166549 A1 Aug. 4, 2005

(30) Foreign Application Priority Data

Feb. 4, 2004 (DE) ..... 10 2004 005 632

(51) Int. Cl.
*G06F 7/00* (2006.01)

(52) U.S. Cl. ..... 700/227; 700/225

(58) Field of Classification Search ..... 700/227, 700/213, 214, 216, 225, 226, 229
See application file for complete search history.

(56) References Cited

U.S. PATENT DOCUMENTS

| | | | | |
|---|---|---|---|---|
| 5,153,842 | A * | 10/1992 | Dlugos et al. | 700/227 |
| 5,971,587 | A * | 10/1999 | Kato et al. | 700/115 |
| 6,226,965 | B1 * | 5/2001 | Lam | 53/491 |
| 6,308,109 | B1 * | 10/2001 | Yuyama et al. | 700/228 |
| 6,317,648 | B1 * | 11/2001 | Sleep et al. | 700/216 |
| 6,332,098 | B2 * | 12/2001 | Ross et al. | 700/226 |
| 6,405,102 | B1 * | 6/2002 | Swartz et al. | 700/225 |
| 6,609,041 | B1 * | 8/2003 | Sanka et al. | 700/115 |
| 6,701,218 | B2 * | 3/2004 | Koike et al. | 700/235 |
| 6,745,027 | B2 * | 6/2004 | Twitchell, Jr. | 455/422.1 |
| 6,775,582 | B2 * | 8/2004 | Schaaf et al. | 700/116 |
| 6,839,604 | B2 * | 1/2005 | Godfrey et al. | 700/116 |
| 6,892,512 | B2 * | 5/2005 | Rice et al. | 53/445 |
| 6,901,304 | B2 * | 5/2005 | Swan et al. | 700/115 |
| 7,006,893 | B2 * | 2/2006 | Hart et al. | 700/235 |
| 7,069,100 | B2 * | 6/2006 | Monette et al. | 700/116 |
| 2003/0229417 | A1 * | 12/2003 | Gyger et al. | 700/222 |
| 2006/0049250 | A1 * | 3/2006 | Sullivan | 235/385 |
| 2006/0125640 | A1 * | 6/2006 | Oakes et al. | 340/572.7 |
| 2006/0149407 | A1 * | 7/2006 | Markham et al. | 700/108 |
| 2006/0206235 | A1 * | 9/2006 | Shakes et al. | 700/216 |

FOREIGN PATENT DOCUMENTS

| | | |
|---|---|---|
| DE | 37 18 215 | 12/1987 |
| DE | 295 12 791 | 8/1996 |
| GB | 2 299 987 | 10/1996 |

* cited by examiner

*Primary Examiner*—Khoi H. Tran
(74) *Attorney, Agent, or Firm*—Andrew Wilford

(57) ABSTRACT

A method for process control and documentation in a boxing machine for individual packages each having an individual package transponder and wherein the individual packages are stacked and the box is provided with a transponder as well. A writing unit writes information with respect to the individual packages to the respective individual package transponders and a reading unit for the transponders serves to control subsequent packaging operations. The operations are also documented on the box transponder.

11 Claims, 2 Drawing Sheets

METHOD FOR PROCESS CONTROL AND DOCUMENTATION IN A BOXING MACHINE

FIELD OF THE INVENTION

Our present invention relates to a method of process control and documentation in a boxing machine, i.e. a packaging machine of the type in which individual packages, such as blister packs, strip packs or the like, usually with informational material such as specifications or description sheets or folders or brochures, are packed in a box, usually a folding box which can be erected to receive the individual packages.

BACKGROUND OF THE INVENTION

In the food industry and in the pharmaceutical industry it is frequently necessary to package individual packages or packs, especially blister packs, strip packs or the like in folding boxes or cartons.

In these fields so necessary to health, well-being and even survival of the consumer, the requirements for control and monitoring of the packaging process are extremely high. This is especially the case with pharmaceutical products since all pharmaceutical products must be packaged with the utmost care to ensure that the requisite number of items are provided, that the quality is maintained and that, indeed the packaging process can proceed with the minimum of handling or delay. It is desirable but even required by law or regulation not only that the packaging process proceed without error or defect but also that the packaging process steps as well as the characteristics of the product packaged and the informational material inserted be documented so that, if necessary, problems can be traced back or documented events communicated to appropriate authority.

OBJECTS OF THE INVENTION

It is, therefore, the principal object of the present invention to provide a method of process control and documentation of the packaging of individual packaging in a packaging machine whereby the aforementioned assurances can be given and problems encountered in earlier systems can be avoided.

It is thus also an object of this invention to provide a method whereby the packaging procedure can be monitored and documented and further such that in each box or carton supplied to a consumer, the expected number of articles in the expected quality are contained.

Another object of the invention is to provide an improved method of ensuring the number and quality of individual packages in a package, especially a folding box, containing a multiplicity of such individual packages.

SUMMARY OF THE INVENTION

These objects and others which will become apparent hereinafter are attained in accordance with the invention, in a method for the process control and documentation of the packaging of individual packages in a packaging machine, especially a boxing machine, in which the individual packages are packed in respective folding boxes or cartons. The method comprises the steps of:

(a) providing each of the individual packages with a respective transponder individual to the respective package;

(b) with a first writing unit registering in each of the transponders individual to a respective package characterizing information and information capable of documenting the individual package;

c) subsequently subjecting the individual packages to further processing in the packaging machine including packing a plurality of the individual packages in a box;

(d) before the individual packages are packaged in a respective box, reading information from the transponders with at least one reading unit; and (e) controlling commencement of at least one operation of the subsequent processing in response to correct information for the operation as read by the reading unit.

Because of the use of transponder technology in the packing process, information can be written to the transponders individual to the respective individual packages and then read therefrom during the progress of the packing process and used to control and monitor the packaging process. Should there be an interruption or problem during the packaging process, for example an improper article, a defectively labeled (via the individual transponder) product or the like, the corresponding individual package will be characterized by that and so labeled via its transponder so that it can be isolated directly or at a later point in time or can be separately packaged with other individual packages likewise sorted from the main packaging operations.

According to a feature of the invention, the individual packages are advanced in the packaging machine on a pack transport chain or conveyor and fed to a location in which a correct number of the individual packages are accumulated in a stack, for example, in a following box. The individual transponder for each of the respective individual packages can be applied to them before the individual packages pass the writing unit described above. The stack can be monitored by the reading unit which can provide the optional count of the individual packages. However, while the stack may include a plurality of blister packs, for example, the invention is also applicable to the packaging in the carton or box of a single individual package under control of the reading unit. The latter packaging step, however, may be controlled, regulated or monitored by the reading unit so that the correct number of individual packages in the stack will always be provided and, in addition, the system can always ensure that only a correct package, as determined by the reading of its transponder, is present in the box or carton. This eliminates the need for other, especially optical processes or devices, for counting the number of packages.

While a positive control of the stack formation is ensured by the first reading unit, a second writing unit can be provided for a transponder of the stack itself to provide, by writing of additional information onto that transponder, documentation that the further packaging operations have been carried out in a defect-free manner.

In this manner, not only can the transponder register information specific to the individual package but it is possible to register thereon further relevant information, which need not directly concern the individual package but may relate to process parameters of the packaging operation and thus enables the documentation of these operations including, for example, if desired, characteristics of the stack formed by a plurality of the individual packages or the manner in which they have been boxed.

In a preferred embodiment of the invention, the box or carton itself is provided with a transponder which can, via a further writing unit, have registered therein information serving to singularly identify the box and, if desired, its contents. This information can include especially the product name, the packing sizes or unit sizes and further information as to the products contained in the box, for example the minimum authorized or actual use duration or life of the product or instructions as to its use.

This process step has been found to have special advantage since it can establish a link between the individual packages and box which can be ascertained at the delivery site or use point of the product and at any time in the transport process to that point. According to a feature of this aspect of the invention, the transport chain downstream of the station at which the individual packages are inserted into the box is provided with a first write-read unit which can copy information from the transponder of one of the individual packages or from a plurality or all of the individual packages in the box to the transponder of the box, the information registered by the latter transponder including at the very least information of the presence and number of the individual packages therein for documentation purposes. This of course will establish a singular relationship between the individual packages and the box which can be later monitored or evaluated so that, for example, a later replacement of the box content or so-called repackaging can be detected. For example, medical materials with an expired date cannot be repackaged in a box printed with an effective date in the device and marketed on the black market.

When the pack insertion station has a fourth writing unit juxtaposed therewith, it is possible to document the correct insertion of informational material (e.g. brochures) in the box, thereby enabling supply of the box together with that informational material.

In accordance with the invention, moreover, a first system is provided to detect the correct insertion of the individual packages or packs and the informational material and then to use a fifth writing unit to document the packaging of both upon the box transponder.

Since the box itself should be characterized by a printed or otherwise impressed (embossed) preferred or mandated use date so that the end user can determine the expiration date of a product without a reader for the transponder, it is a feature of the invention that a second recognition system is provided which can ensure the correct application of the embossed or printed material on the box. With the aid of a third recognition system, the application of an adhesive the flap of the box is controlled, also based on information on the transponders since the correct closure of the box seals the individual packages in the box and ensures the reliability of the documentation of the box.

For further and complete documentation of the packaging process it is provided, according to the invention that by means of a sixth writing unit and optionally a seventh writing unit, correct application of the embossed or printed image and application of the adhesive and the parameters of the adhesive application and closure of the box can be documented on the box transponder. A complete acquisition of the details with respect to the packaging process can be used, for example, by means of a fourth recognition system to monitor application of adhesive to a further flap of the box and this can be documented by still an eighth writing unit upon the box transponder.

If desired, by means of a fifth recognition system, the correct closure of the box can be controlled and by means of a ninth writing unit, the closure itself can be documented on the box transponder.

In a preferred embodiment of the invention, utilizing a third write-read unit, the contents of the box transponder can be read out and indicated by documentation on its transponder where the packaging has been indicated to be free from defects and a status of "good packing" has been achieved. This status is assigned to those cases in which the various procedures controlled by information registered on the transponder have proceeded without defect, the correct number of individual packages and the correct packages as indicated by their registered characteristics are present in the box with the correct informational material, brochures and other materials, and the box has been closed properly and in accordance with the correct parameters. Only those boxes with the status "good packing" can then be supplied from the machines to the customers.

At the end of the packaging process, therefore, one can obtain a box whose contents are, without fail, the correct one for this box, and a box which itself cannot be tampered with without notice to the ultimate consumer or vendor, thereby providing the greatest possible assurance to the manufacturer of the reliability and safety of his production process and rendering more complex any attempt at product falsification.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
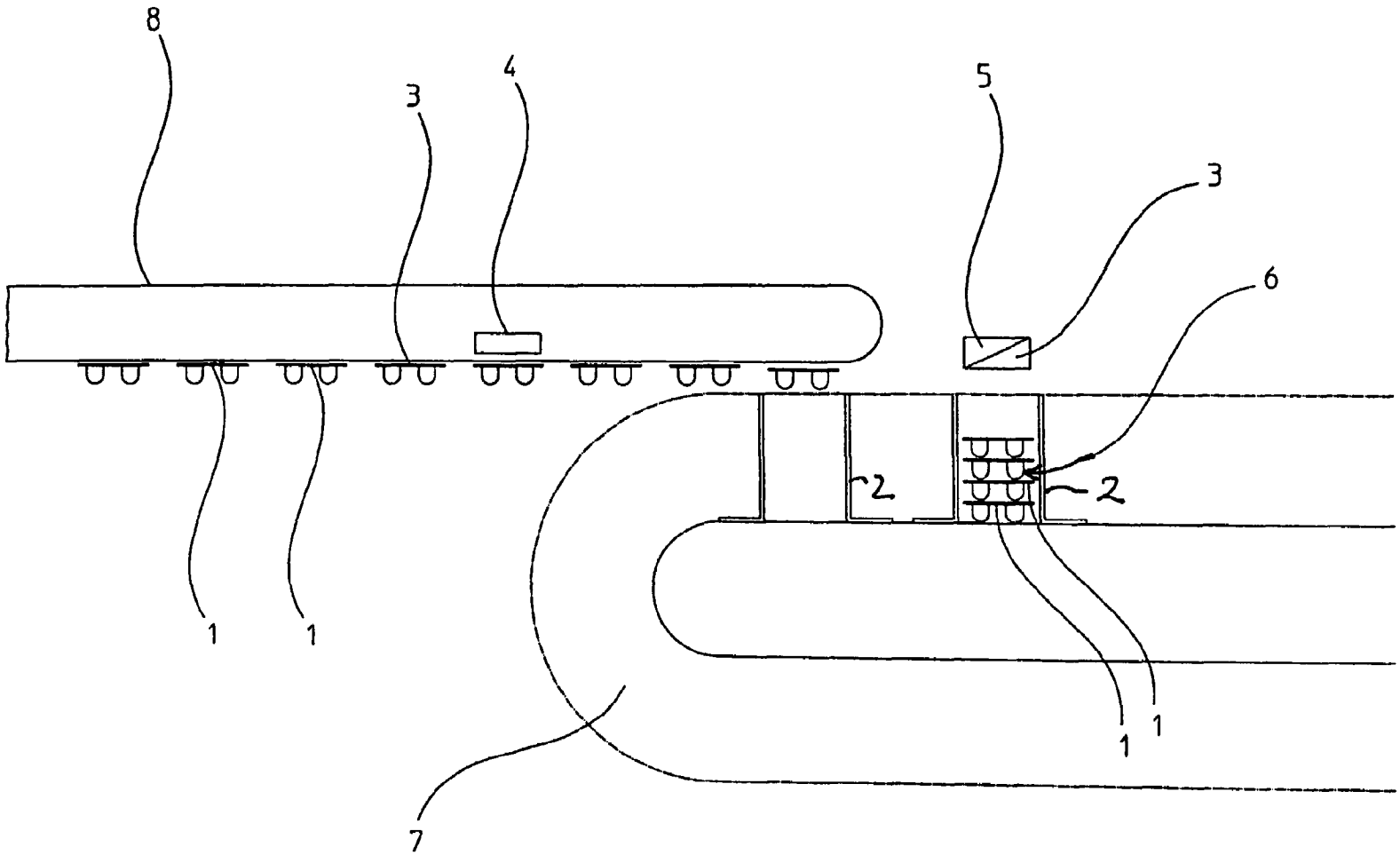
FIG. 1 is a diagrammatic illustration of a portion of a packaging machine showing schematically the stack formation and its control utilizing the transponder technique.

The method of the present invention is used for process control and documentation with a packaging machine or boxing machine in which the individual packages or packs 1, for example, blister packs or strip packs or the like, are to be packaged in a box 2, especially a folding box. In accordance with the invention the individual packages 1 are provided with respective transponders 3 which register information transmitted to them by a first write unit. In this sense a transponder is-understood to be an electronic circuit, chip or the like which can be embedded in a sheet or which otherwise is applied to the blister pack. A cardboard support for the blister pack may, for example, be provided with that chip and an appropriate antenna which allows communication with the chip in a wireless transmission, either or RF energy or by a magnetic induction field or the like.

Each transponder can engage in bilateral communication, i.e. can register information delivered to it by a writing unit or head and can be triggered to transmit information to a reading head, also in a wireless manner.

Each of the blister packs 1 with the respective transponder 3 can be displaced past the writing unit or head 4 on a feed conveyor represented in highly diagrammatic form at 8. The information applied to the transponder can be, for example, a simple number of a succession of progressively increasing numbers representing a count of the individual packages, or more complex information including information as to the product contained in the individual pack 1 and its history in the course of fabrication of the individual pack 1, or information with respect to the packaging of the product in the individual packs, for example, details as to the deep drawing, following a sealing.

The information may include the expiration date, details of use, ingredients, physical nature of the product or the like. Through a reading unit 5, the existence of the correct starting conditions for a subsequent process step (in the packaging especially) can be controlled or determined so that that subsequent step can be initiated. In the embodiment of FIG. 1, this occurrence of the proper state for commencing a subsequent step may be the correct formation of a stack 6 from the plurality of the individual packages 1 in a transport chain 7 for the packages. The indication that the correct starting conditions for a further or optional method step is present, however, is communicated by the reader 5 which can, for example, count the number of individual packages by ascertaining a count number from reading corresponding information registered on the individual transponders.

In the illustrated system, the individual packages 1 are delivered to the stacks by means of the conveyor 8 which can have a vacuum belt to which the individual packs adhere and which passes the individual packs below the writing unit 4 which, in the example described, registers a successive number for each pack in the transponder thereof. The reading head 5 controls the correct stack formation by reading these numbers and when the correct number of individual packs has been stacked in, for example, an unfolded box of the transport chain 5, the next operation can be commenced. The transponder information read at 5 need not be limited to the number of the package but can include other information which can initiate further operations of the packaging machine.

Figure 2:
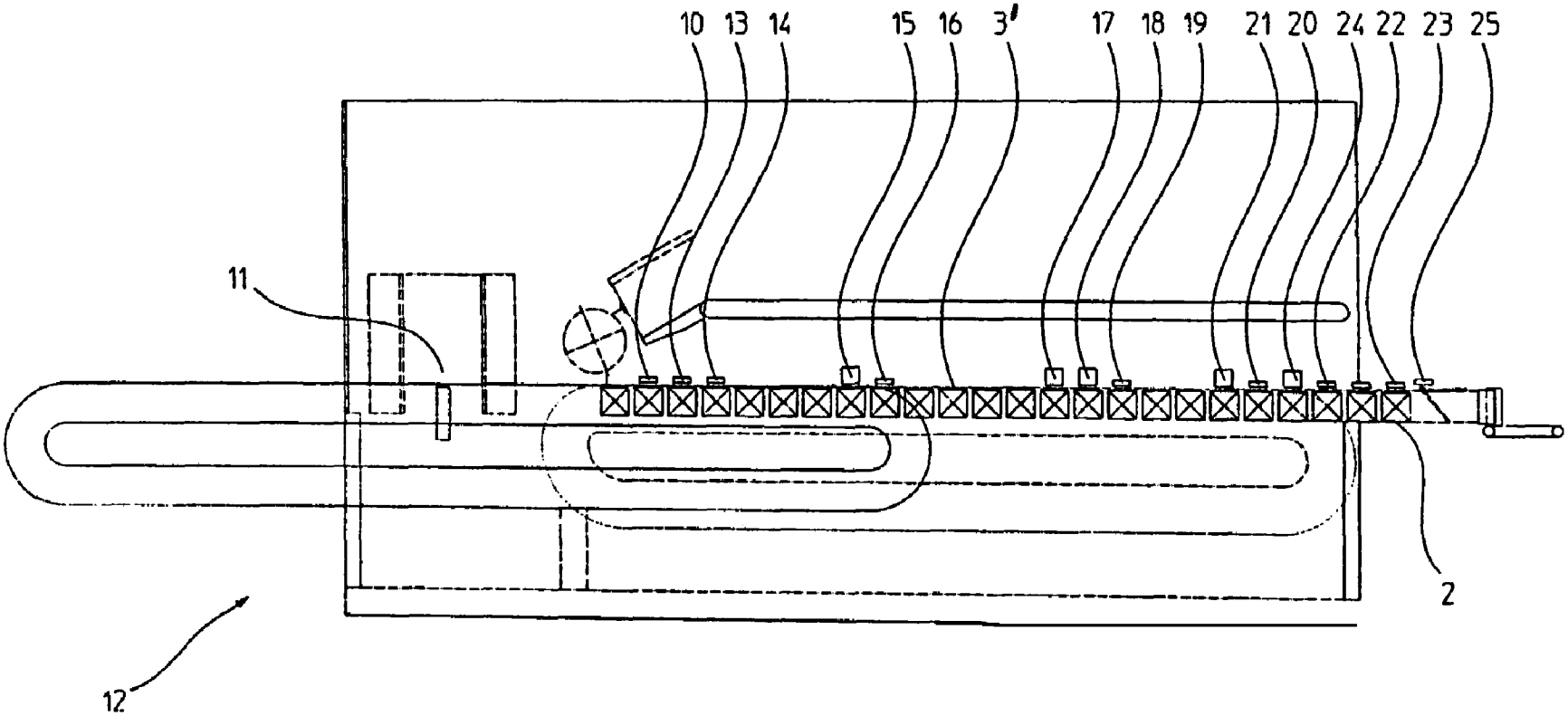
FIG. 2 is a diagrammatic illustration showing a package insertion station of a box machine in side view as pertains to the present invention.

According to the invention, the box 2 is likewise provided with a transponder 3' (FIG. 2) so that, by means of another writing unit 10, specific information as to that box 2 can be recorded on its transponder to identify that particular box and the contents thereof. At least part of the information registered at 10 in the box transponder 3' can derive from the reading at 5 of the individual package transponders. The box may include informational material 11 which can be inserted into the box, e.g. in the form of printed matter or a brochure, folder or the like, introduced at 11, based upon information derived from the reader 5.

The pack insertion station is represented at 12 and the box as there shown will be understood to be singularly identified by the respective box transponders 3' and the information registered thereon.

Following the insertion station 12 along the transport chain 7 is a first write/read unit 13 which can copy on the transponder 3' information contained in the transponders of the individual packs 1 and documenting the presence and number (and nature) of the individual packs 1 in the box.

The pack insertion station 12 has a fourth writing unit 14 associated therewith for documenting the fact that the informational materials 12 have been added to the box 2 and, if desired, identifying such informational material. The subsequent step which may involve insertion of the individual packs 1 into the box containing the informational material, when the packs have not been previously inserted, can be responsive to a first recognition or detection system 15 and the operation thereof can be documented by a fifth writing unit 16 registering appropriate information on the transponder 3' of the box 2.

In that case, a second recognition or detection system 17 is provided for controlling the correct application of an embossed image or print on the box to provide information to the final consumer when the consumer does not have available a reading device for reading out the information recorded by the box transponder 3'.

A third detection or recognition system 18 is provided to control the application of an adhesive to one flap of the box 2. The information as to the action of the second and third recognition system 17 and 18 can be registered in the box transponder 3' by sixth and seventh writing units 19 and 20. The same applies to information from a fourth recognition or detection system 21 which controls the application of an adhesive to a further flap of the box 2 whose operation can be documented in the transponder 3' of the box by an eighth writing unit 22.

Finally also by means of a fifth recognition and detection system 24, the correct closing of the box 2 can be monitored or detected and information as to the closing can be documented by registered it on the box transponder 3' using the ninth writing unit 23. At the end of the packing process a third write/read unit 25 reads the contents of the box transponder 3', evaluates those contents and, if the box 2 has been packed without defect, assigns the status "good packing" to the box and writes that status to the box transponder 3'. Only boxes 2 with the "good packing" status are delivered by the packaging machine for use by a consumer or distributor.

We claim:

1. A method for the process control and documentation of the packaging of individual packages in a packaging machine, said method comprising the steps of:

(a) providing each of said individual packages with a respective transponder individual to the respective package;

(b) with a first writing unit registering in each of said transponders individual to a respective package characterizing information and information capable of documenting the individual package;

c) subsequently subjecting the individual packages to further processing in said packaging machine including packing a plurality of said individual packages in a box;

(d) before said individual packages are packaged in a respective box, reading information from the transponders with at is least one reading unit; and (e) controlling commencement of at least one operation of said subsequent processing in response to correct information for said operation as read by said reading unit;

(f) providing each box with a transponder;

(g) writing with at least a second writing unit to the respective box transponder information identifying the respective box;

(h) advancing said box along a box transport chain through a package insertion station and past a third write/read unit for copying on the box transponder information from at least one individual package transponder of a respective box, (i) documenting correcting insertion of a piece of informational material in said box on the respective box transponder with another fourth writing unit of the insertion station; and (j) recognizing correct insertion of individual packages and the piece of information material in said box and documenting such recognition in the respective box transponder with another fifth writing unit.

2. The method defined in claim 1 wherein at least one piece of informational material is inserted in each box with the individual packages.

3. The method defined in claim 1 wherein the individual packages are fed in succession to a box transporter for stacking in a respective box, the stacking being controlled based upon information read from the transponders of the individual s packages by said at least one reading unit.

4. The method defined in claim 3, further comprising another sixth writing unit, generating information indicative of a defect from stacking of the individual packages for documenting same upon at least one transponder.

5. The method defined in claim 1 wherein data copied from an individual package transponder to said box transponder links the contents of the box with the information contained on the box transponder and wherein the s information contained in the box transponder represents documentation as to the presence, nature and number of individual packages in said box.

6. The method defined in claim 1 wherein information is embossed or imprinted on said box, further comprising another second recognition system for controlling the correct application of the information by printing or embossing onto said box.

7. The method defined in claim 6, further comprising another third recognition system for controlling application of an adhesive to one flap of said box.

8. The method defined in claim 7, further comprising another seventh writing unit for documenting on said box transponders correct application of a print or embossed image on the box and a eight writing for documenting on the box transponder the S application of the adhesive and parameters with respect to adhesive application to said flap of the box.

9. The method defined in claim 8, further comprising another fourth recognition system for controlling the application of adhesive to said other flap on the box transponder.

10. The method defined in claim 9, further comprising another fifth recognition system for controlling closing of said flap and another ninth writing unit for documenting correct closing of the flaps on said box transponder.

11. The method defined in claim 10, further comprising another tenth write/read unit for reading contents of the box transponder, evaluating same and documenting the "good packing" status on said box transponder.

* * * * *